US009377191B2

(12) United States Patent
LaRue et al.

(10) Patent No.: US 9,377,191 B2
(45) Date of Patent: Jun. 28, 2016

(54) BURNER WITH FLAME STABILIZING/CENTER AIR JET DEVICE FOR LOW QUALITY FUEL

(71) Applicant: Babcock & Wilcox Power Generation Group, Inc., Barberton, OH (US)

(72) Inventors: Albert D LaRue, Uniontown, OH (US); Zumao Chen, Copley, OH (US); Keir D McQuistan, Rittman, OH (US)

(73) Assignee: The Babcock & Wilcox Company, Barberton, OH (US)

( * ) Notice: Subject to any disclaimer, the term of this patent is extended or adjusted under 35 U.S.C. 154(b) by 350 days.

(21) Appl. No.: 13/926,488

(22) Filed: Jun. 25, 2013

(65) Prior Publication Data

US 2014/0373763 A1 Dec. 25, 2014

(51) Int. Cl.

| | |
|---|---|
| ***F23D 1/02*** | (2006.01) |
| ***F23D 1/00*** | (2006.01) |
| ***F23C 9/00*** | (2006.01) |

(52) U.S. Cl.

CPC ..... *F23D 1/005* (2013.01); *F23C 9/003* (2013.01); *F23D 1/00* (2013.01); *F23D 1/02* (2013.01); *F23C 2201/20* (2013.01); *F23C 2900/06043* (2013.01)

(58) Field of Classification Search

CPC ..... F23D 1/00; F23C 9/003; F23C 6/047

See application file for complete search history.

(56) References Cited

U.S. PATENT DOCUMENTS

| | | | | | |
|---|---|---|---|---|---|
| 1,510,645 | A | * | 10/1924 | Bergman | F23D 1/00 110/104 B |
| 1,827,727 | A | * | 10/1931 | Blizard | F15D 1/04 110/184 |
| 2,903,051 | A | * | 9/1959 | Blackman | C21D 9/70 126/91 A |
| 3,050,341 | A | * | 8/1962 | Whitney, Jr. | F04D 23/003 406/100 |
| 3,256,842 | A | * | 6/1966 | Vigneron | F23D 11/00 110/261 |

(Continued)

FOREIGN PATENT DOCUMENTS

EP 1219893 1/2006

OTHER PUBLICATIONS

LaRue, A., Rowley, D., Sarv, H., Kahle, W., Sayre, A., "B&W's AireJet(TM) Burner for Low NOx Emissions," Technical Paper, Nov. 28-30, 2006, pp. 1-6.

*Primary Examiner* — Jason Lau

(74) *Attorney, Agent, or Firm* — Eric Marich

(57) ABSTRACT

The present disclosure relates to a center air jet burner for burning low quality fuel including an annular pipe having a fuel inlet and a fuel outlet. A core pipe that includes a first opening and an opposite second opening that defines an inner zone, the core pipe extends within the annular pipe defining a first annular zone. A burner elbow is configured to supply a fuel airflow mixture including pulverized coal and primary air to the fuel inlet and the first opening. The first opening of the core pipe is eccentrically aligned relative to the fuel inlet of the annular pipe such that the fuel airflow mixture passing through the burner elbow is divided into an outer fuel rich stream having an increased amount of pulverized coal within the first annular zone and an inner fuel-lean stream having an increased amount of primary air within the inner zone.

15 Claims, 6 Drawing Sheets

(56) References Cited

U.S. PATENT DOCUMENTS 3,429,300 A * 2/1969 Eisentrout ..... F23D 17/00 122/6.5
3,920,383 A * 11/1975 Kerr ..... F23C 3/002 126/91 A
4,274,343 A * 6/1981 Kokkinos ..... F23D 1/00 110/106
4,380,202 A * 4/1983 LaRue ..... F23D 1/00 110/263
4,387,654 A * 6/1983 Binasik ..... C21B 13/08 110/106
4,457,241 A 7/1984 Itse et al.
4,497,263 A 2/1985 Vatsky et al.
4,611,543 A * 9/1986 Collette ..... F15D 1/04 110/106
4,627,366 A 12/1986 LaRue et al.
4,654,001 A * 3/1987 LaRue ..... F23D 1/00 110/263
4,836,772 A * 6/1989 LaRue ..... F23D 17/00 110/263
4,915,619 A 4/1990 LaRue
4,934,284 A * 6/1990 Nitz ..... F23D 1/00 110/232
5,199,355 A 4/1993 LaRue
5,470,224 A * 11/1995 Bortz ..... F23C 6/045 431/116
5,526,758 A * 6/1996 Giammaruti ..... F23D 1/00 110/261
5,685,242 A * 11/1997 Narato ..... F23C 6/047 110/104 B
5,697,306 A 12/1997 LaRue et al.
5,829,367 A * 11/1998 Ohta ..... F23D 1/00 110/104 B
5,937,770 A * 8/1999 Kobayashi ..... F23D 1/00 110/104 B
7,430,970 B2 * 10/2008 LaRue ..... F23C 7/008 110/261
2008/0283039 A1 * 11/2008 Waltz ..... F23L 9/02 126/290
2010/0242813 A1 * 9/2010 Takashima ..... B01D 45/08 110/263
2012/0152158 A1 * 6/2012 Matsumoto ..... F23C 6/045 110/347
2012/0247376 A1 * 10/2012 Matsumoto ..... F23D 1/00 110/265

* cited by examiner

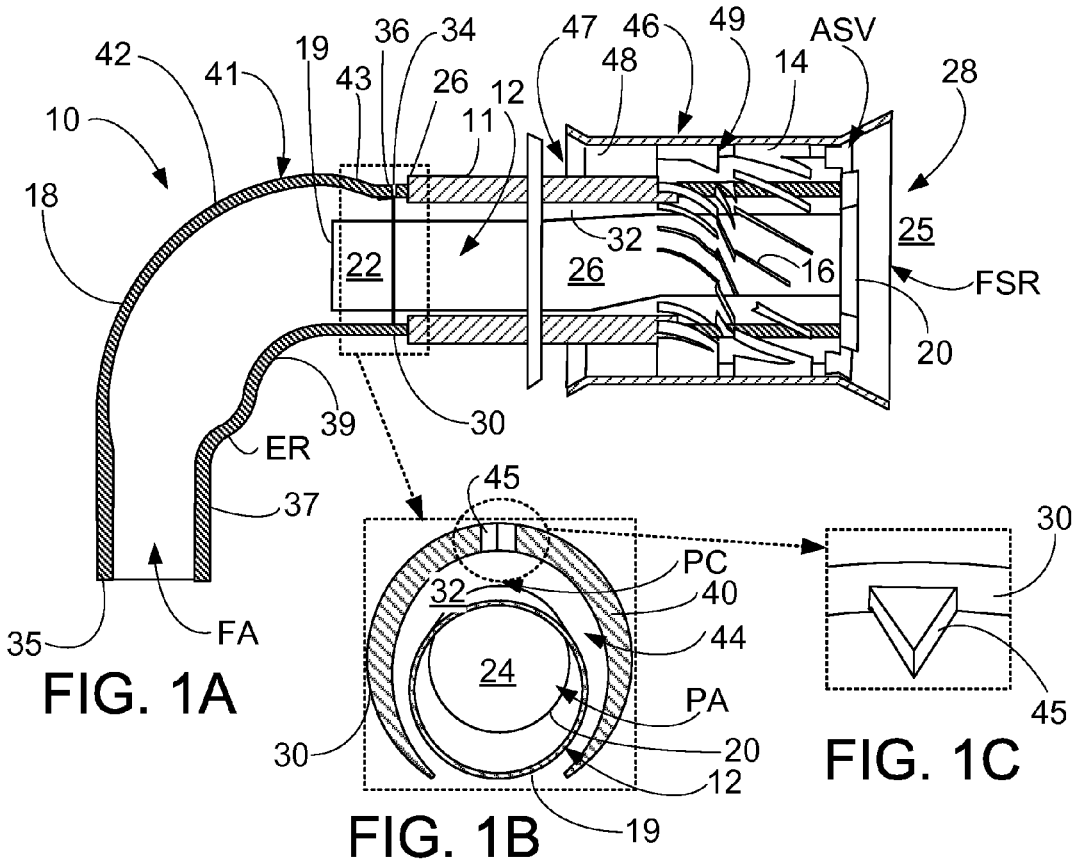
FIG. 1A
FIG. 1B
FIG. 1C
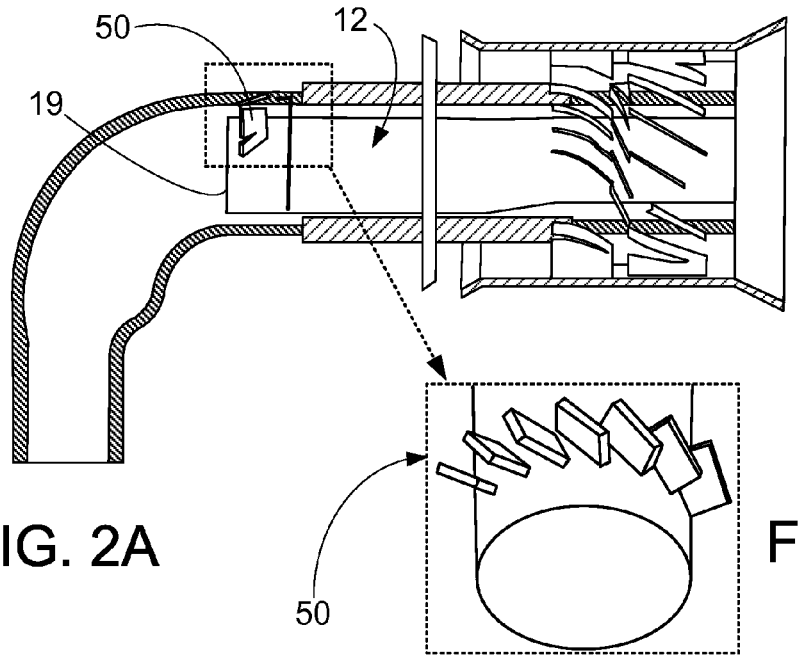
FIG. 2A
FIG. 2B

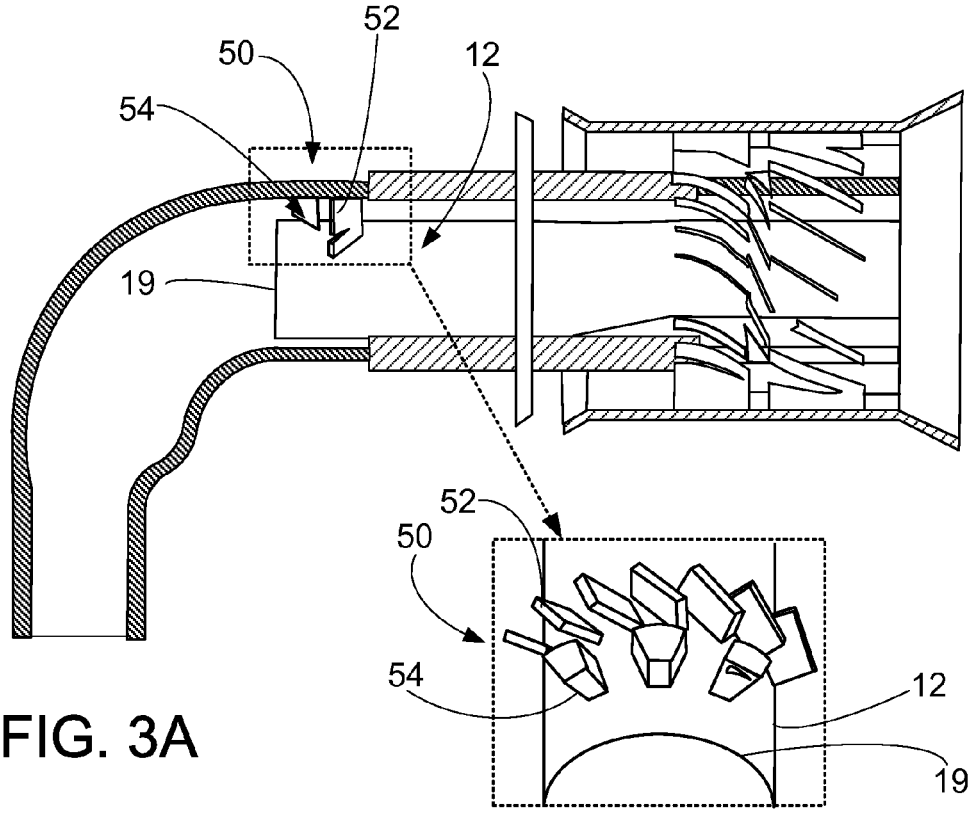
FIG. 3A
FIG. 3B
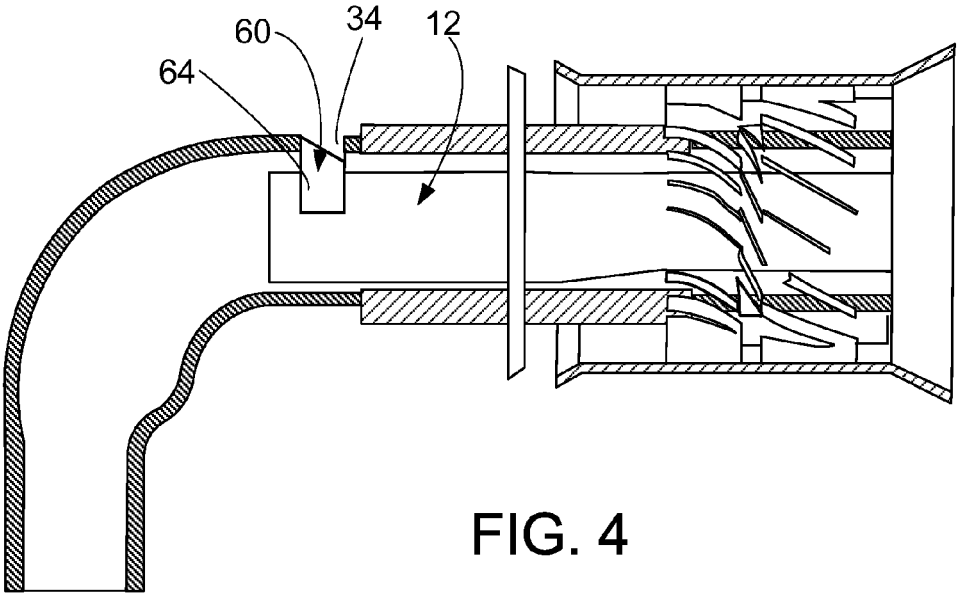
FIG. 4

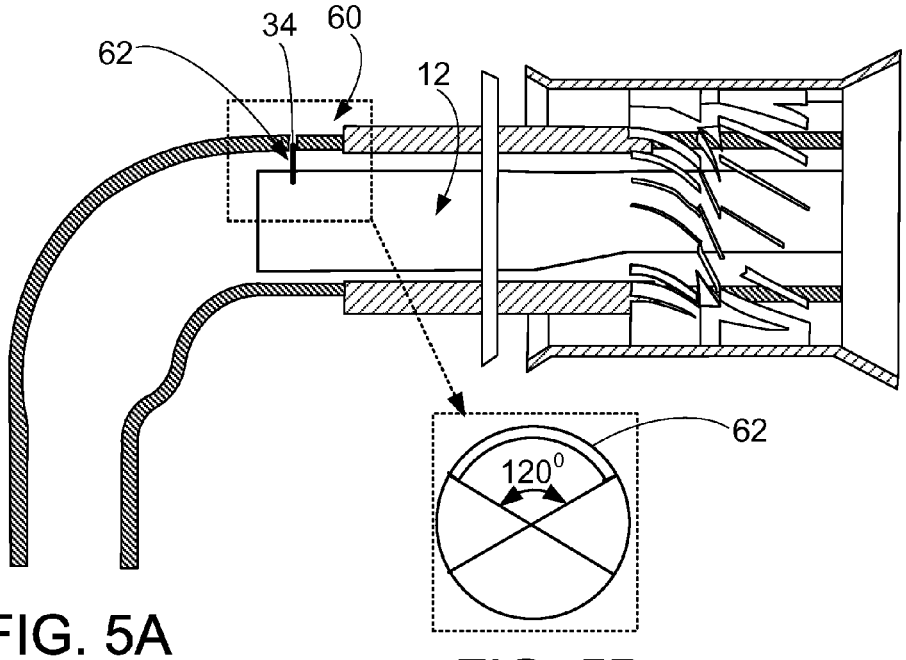
FIG. 5A
FIG. 5B
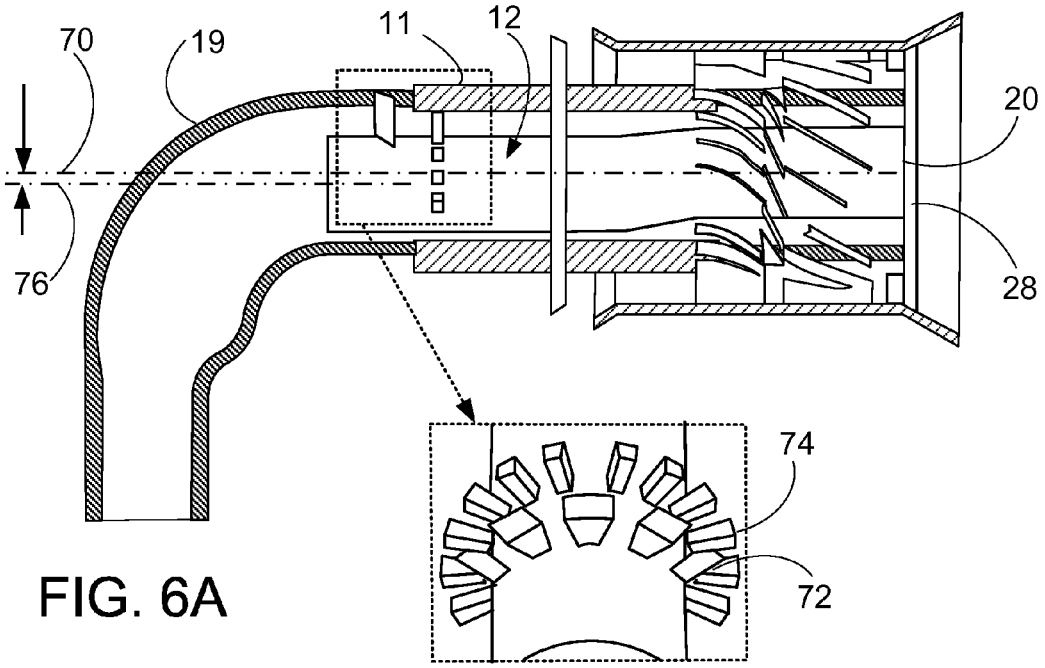
FIG. 6A
FIG. 6B

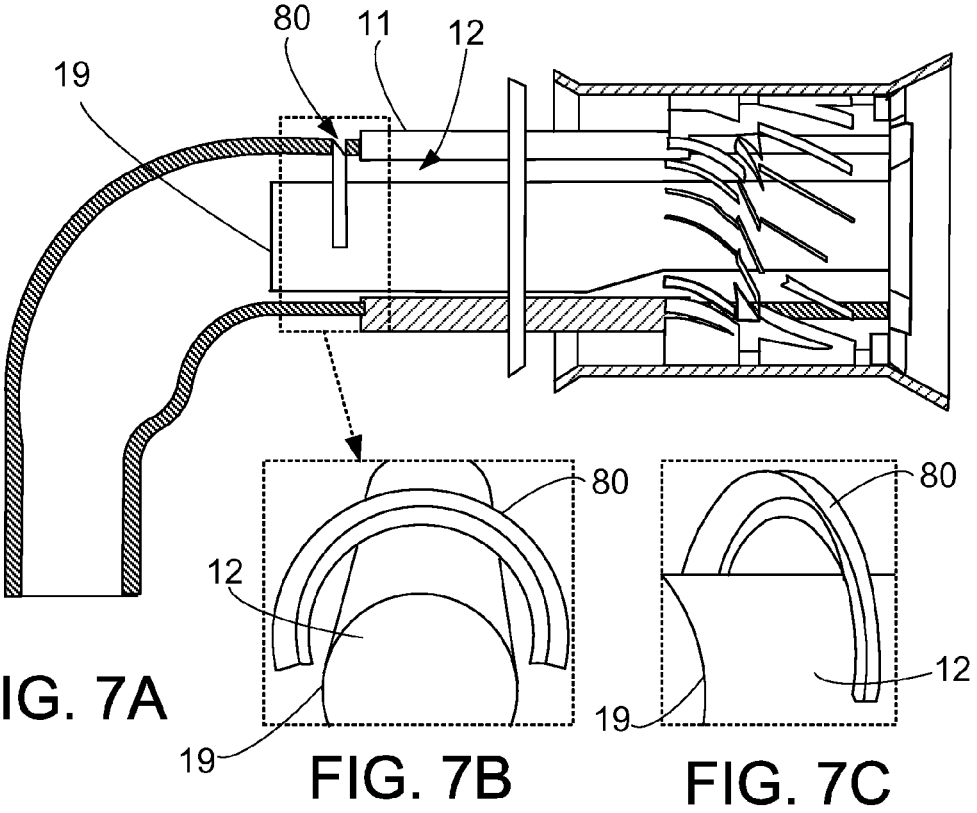
FIG. 7A
FIG. 7B
FIG. 7C
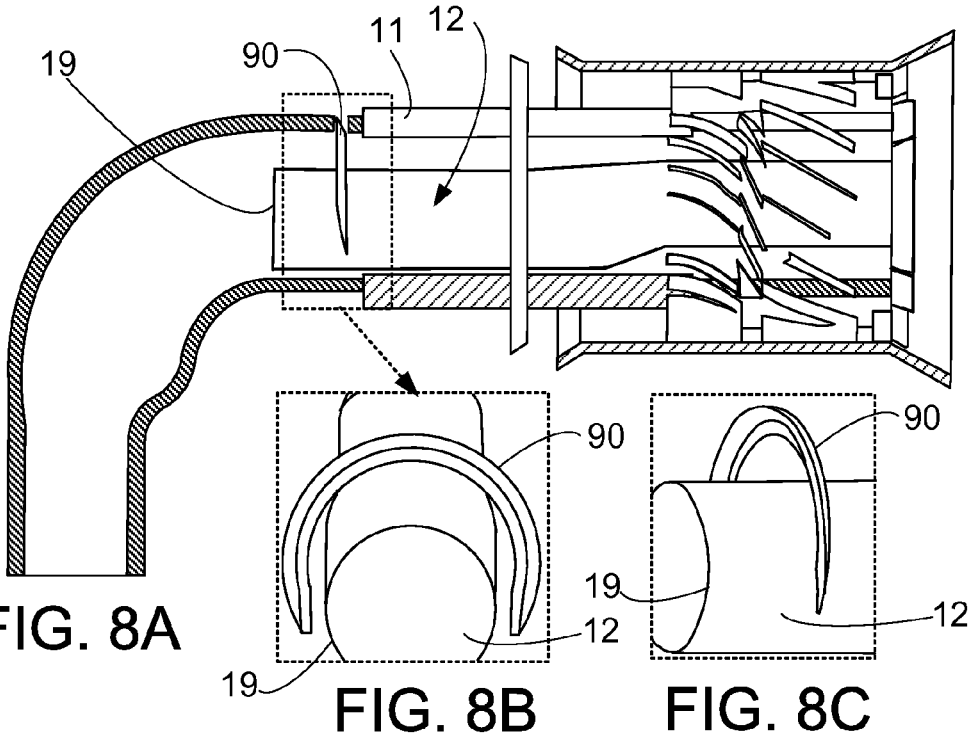
FIG. 8A
FIG. 8B
FIG. 8C

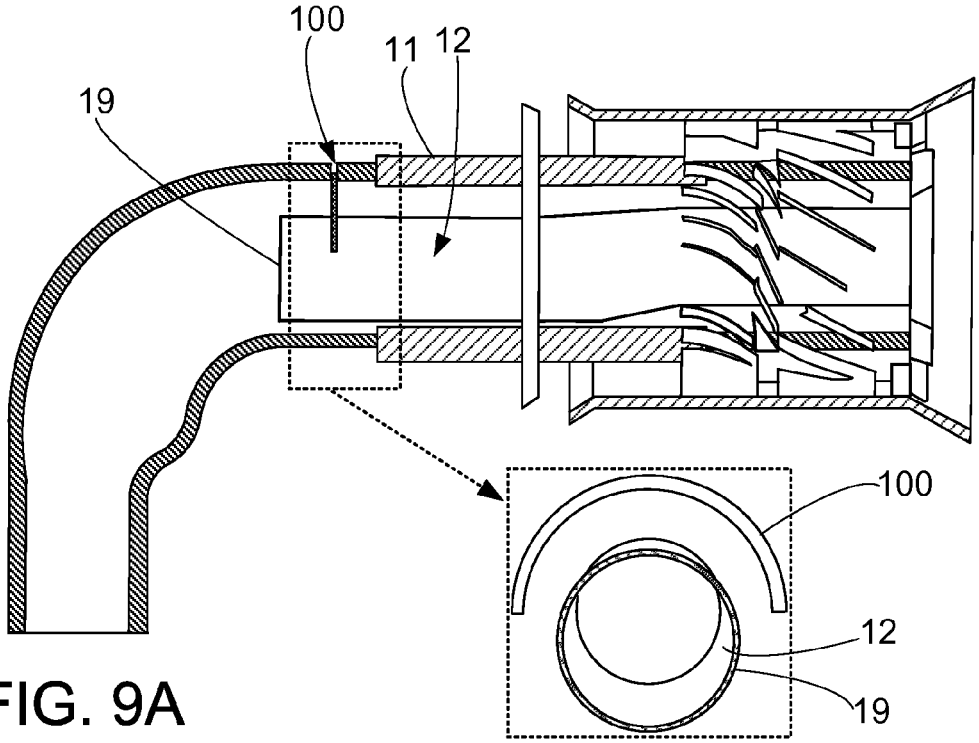
FIG. 9A
FIG. 9B
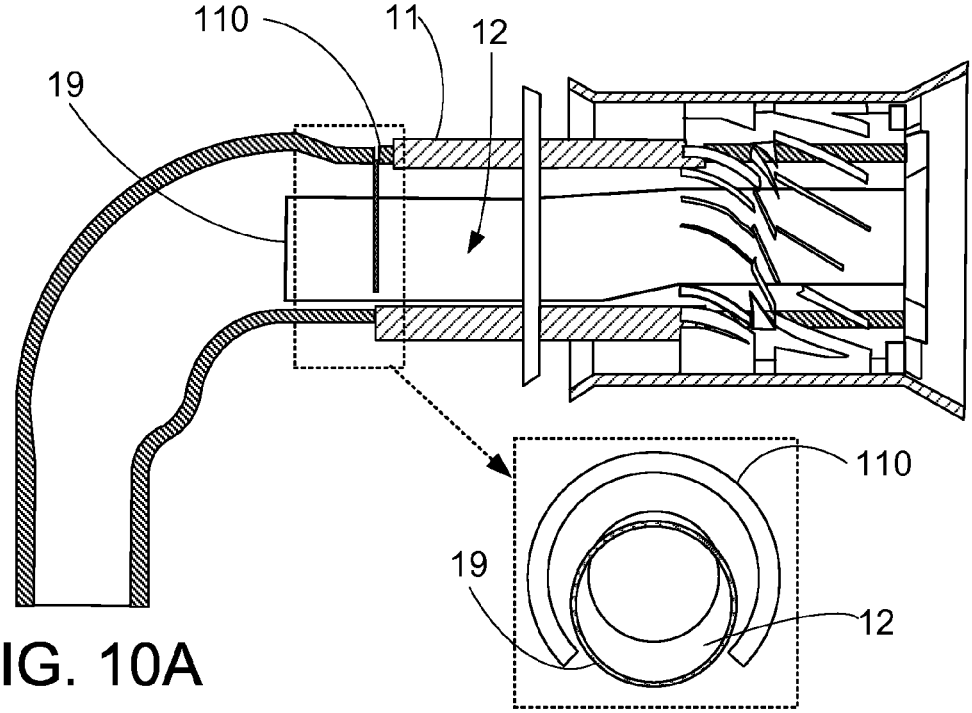
FIG. 10A
FIG. 10B

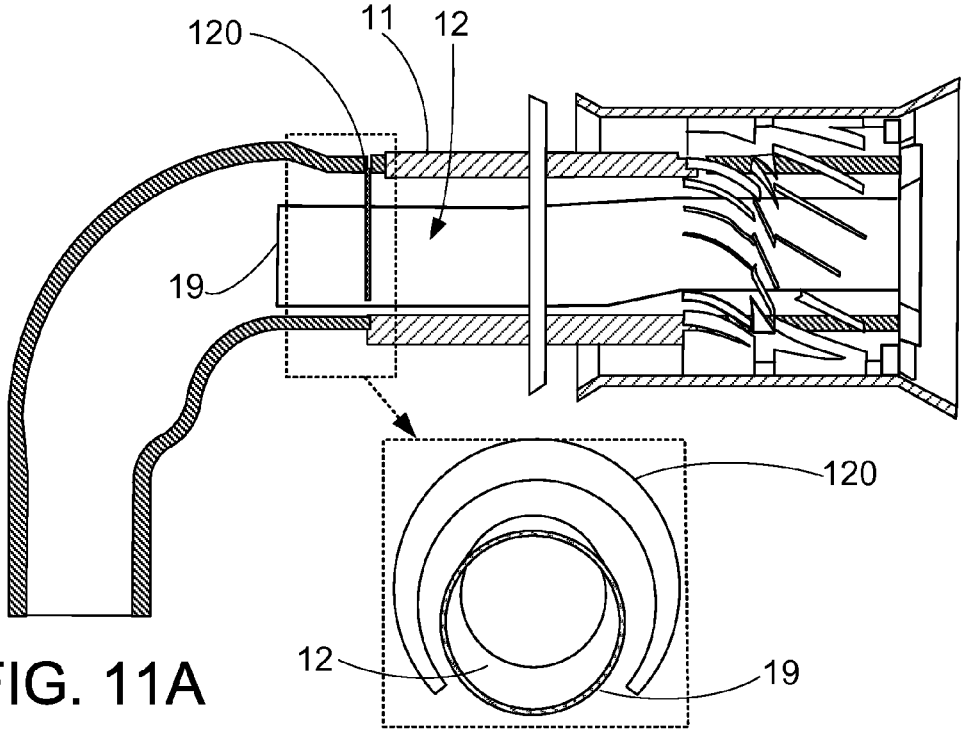
FIG. 11A
FIG. 11B
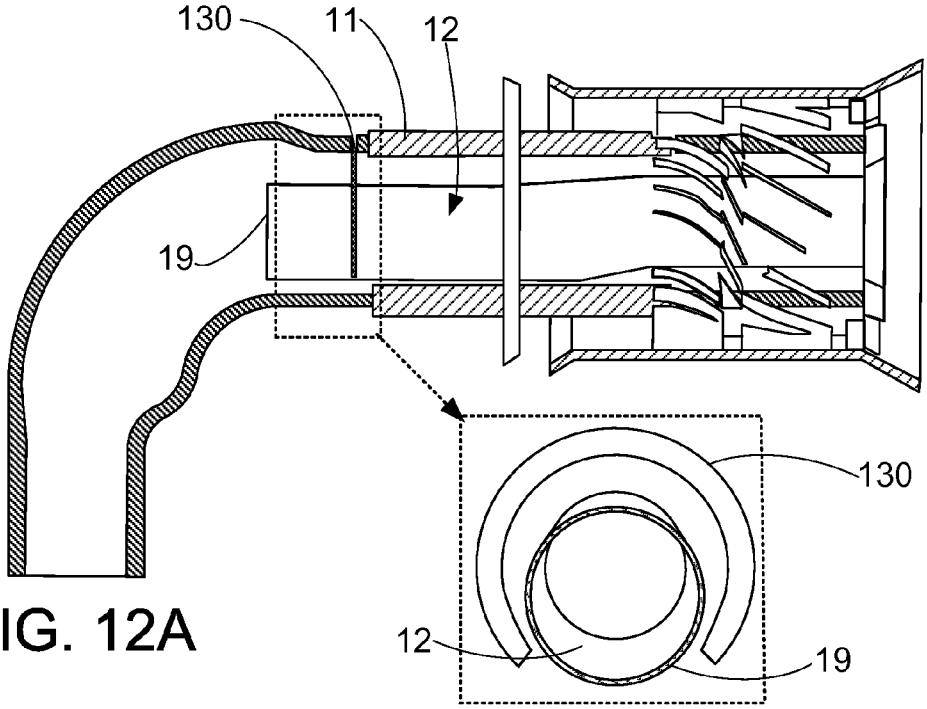
FIG. 12A
FIG. 12B

BURNER WITH FLAME STABILIZING/CENTER AIR JET DEVICE FOR LOW QUALITY FUEL

BACKGROUND

The present disclosure relates in general to a method and apparatus of combustion incorporating a burner nozzle for burning pulverized fuels, such as low quality pulverized coal. More particularly, the present disclosure is directed to affecting a more stabilized flame while reducing nitrogen oxides, during ignition and combustion for low quality pulverized coal, and will be described with reference thereto. However, it is appreciated that the present exemplary embodiment is also amenable to other like applications.

During combustion, the chemical energy in a fuel is converted to thermal heat inside the furnace of a boiler. The thermal heat is captured through heat-absorbing surfaces in the boiler to produce steam. The fuels used in the furnace include a wide range of solid, liquid, and gaseous substances, including coal, natural gas, and diesel oil. Combustion transforms the fuel into a large number of chemical compounds. Water and carbon dioxide ($CO_2$) are the products of complete combustion. Incomplete combustion reactions may result in undesirable byproducts that can include unburned carbon particulates, carbon monoxide (CO), and hydrocarbons (HC).

For a variety of reasons, large pulverized coal (PC) fired boners are increasingly bearing the burden of frequent load swings. The resulting variation in operating levels has increased the operation of these boilers under low load conditions. This consequently heightens the need for a burner capable of a reliable, efficient, low load performance that still enables the formation of nitrogen oxides ($NO_x$) to be kept to an acceptable minimum level. A key factor which increases $NO_x$ formation is the oxygen available in the combustion zone immediately downstream of the burner nozzle.

Typical burner nozzles such as those described in U.S. Pat. No. 4,497,263 issued to Vatsky et al. and U.S. Pat. No. 4,457,241 issued to Itse et al. are of the type where the pulverized coal particles are concentrated into the center of an air-coal stream before these particles are burned in the boiler. This method, although sufficient for the burning of the pulverized coal, contributes to $NO_x$ formation because of the oxygen available during combustion.

Another factor influenced by burner nozzle performance is the stability of the flame. The velocity of the fuel emerging from the nozzle is of prime importance to flame stability. Lower fuel velocities provides more time for the particles to heat up and ignite in the burner throat and thereby achieves a more stable flame. Difficult to ignite fuels, such as low volatile coals, particularly benefit by lower fuel velocity. Lower velocities may also serve to limit air-fuel mixing prior to burning which reduces the availability of oxygen during combustion thereby reducing $NO_x$ formation.

Typical circular low $NO_x$ PC-fired burners have their coal nozzles positioned axially in the burner. $NO_x$ reduction is accomplished by limiting air introduction to the fuel in the near field of the flame, to reduce $O_2$ availability during devolatilization. Limiting the rate of fuel mixing with secondary air in the near field facilitates this, and is accomplished by axial (or near axial) injection of PC into the flame. A direct consequence is that the fuel jet proceeds down the center of the flame, producing a strong fuel rich condition which persists long after devolatilization is completed. This persistent fuel rich central portion of the downstream flame delays char reactions (in absence of oxidant). Delayed char reactions are responsible for increases in unburned combustibles—unburned carbon (solid phase) and carbon monoxide (gas phase). Such increases in unburned combustibles are characteristic of many low $NO_x$ burners.

An effective solution to this problem, higher unburned combustibles with low $NO_x$ burners, is found in the AireJet® burner provided by Babcock & Wilcox Power Generation Group, Inc., which is a burner with a center air jet as disclosed by U.S. Pat. No. 7,430,970. Here, the problem is solved by adding an additional air jet supply axially to the burner, which provides an amount of oxidant to the center of the flame. This teaches supply of about 20 to 40% of the burner oxygen using the center jet, with about 10 to 30% supplied with the coal as primary air. This patent describes benefits of $NO_x$ reduction and flame stability with a burner assembly configured with an additional center air jet. Full scale results in a utility boiler indicate the AireJet® burner accomplished lower $NO_x$ and simultaneously produced low unburned combustibles at lower excess air. See technical paper titled "B&W AireJet™ Burner for Low $NO_x$ Emissions, BR-1788" which is incorporated by reference herein.

However, low quality (LQ) coals may not be directly suitable for use with AireJet® burners. Low quality coals refer to coals with excessive amounts of mineral matter (ie. ash, etc.) and moisture, often exceeding about 50% of the material. These inert materials depress the heating value of the coal, typically from about 10,000 to 12,000 to about 5000 to 7000 Btu/lb (Higher Heating Value [HHV] basis). Such LQ coals require nearly twice the mass throughput compared to higher quality coals in order to provide equivalent heat input. Consequently, twice the coal throughput requires twice the quantity of lower temperature primary air (PA) flow, typically about 130° F. to 200° F., for pulverizers to process LQ coal. This reduces the amount of high temperature secondary air (SA), typically about 600° F.-700° F. available to the burner which impairs flame stability and $NO_x$ control.

The SA/PA ratio provides an indication of relative flame stability. High SA/PA (e.g. 4) means there is proportionally more hot SA available to interact with the PA/PC jet to accelerate ignition, promote flame stability, and to influence flame development. Conversely, as SA/PA drops to a value of 2 or less, there is proportionally much less SA to influence flame development and $NO_x$ and flame stability suffer. For example, consider two coals with equal grindability but one has a heating value of 12,000 Btu/lb and one has a heating value of 6,000 Btu/lb. The SA/PA is over 4 for the 12,000 Btu/lb coal, but drops to 2 for the 6,000 Btu/lb coal. The LQ coal requires twice the PA flow on an input basis, leaving much less SA for flame control. The shortage of SA impairs implementation of AireJet® technology.

Techniques to reduce PA to the burner exist, but add costs and complexity to the process. PA can be removed by a dust separator (cyclonic or baghouse or the like), downstream of the pulverizers. Indirect firing systems employ such equipment. Such systems can fully separate PA and coal and can supply a richer PA/PC mix to the burners, at considerable expense. As an alternative, U.S. Pat. No. 4,627,366 discloses a Primary Air Exchange for a Pulverized Coal Burner and teaches the use of a burner elbow and associated apparatus to separate some PA from the PA/PC stream entering the burner (PAX burner). The separated PA, with a small amount of PC, is vented to the furnace through a pipe to a location in proximity to the burner. This effectively reduces PA to the burner, but increases costs due to associated piping, valves, and furnace wall openings. Locating this additional equipment can be problematic for wall fired boilers, and can require larger burner zones to accommodate.

LQ coals suffer from delayed ignition and poor flame stability due to massive amounts of inert material in such coals, which depress heating values of such coals. Further, the low heating value requires disproportionately high amounts of primary air to pulverize the coal, leaving lesser secondary air to shape the flame and counteract such problems.

Another known solution for this problem is disclosed by U.S. Pat. No. 4,654,001 which is also incorporated by reference and teaches a Flame Stabilizing/NOx Reduction Device for Pulverized Coal Burner, referred to as a DeNOx Stabilizer (DNS). This patent teaches a means of separating a portion of the PA entering a burner elbow and injecting it down the center of the flame. The separation device is like that used in the PAX burner, with a tubular piece concentric with the burner elbow exit capturing a portion of the PA. The concentric tubular piece then conveys this separated stream to the end of the burner and injects it into the furnace. The tubular piece may reduce in cross section as it approaches the end in order to accelerate the stream internal to the tube while decelerating the surrounding fuel rich stream. In use with high quality coals, the DNS provides improved flame stability by decelerating the main fuel jet which provides more residence time in the ignition zone. The DNS provides a richer fuel mixture such that coal devolatilization takes place with less oxidant available and thereby reduces NOx.

It is thus an object of this disclosure to provide a burner nozzle that is efficient and effective to operate with difficult to ignite fuels such as pulverized LQ coal and one which reduces $NO_x$ formation. It is another object of this disclosure to improve separation efficiency of PA from the PA/PC fuel mixture before entering into the furnace of a boiler for improved ignition performance. A further object of this disclosure is to provide a burner nozzle which increases flame stability and one which is easily capable of being retrofitted into existing burners. Another object of this disclosure is to separate the pulverized coal into a relatively fuel-dense low velocity stream and a relatively fuel-dilute high velocity stream with low pressure loss across the nozzle.

BRIEF DESCRIPTION

The present disclosure relates to a center air jet burner for burning low quality fuel including an annular pipe that includes a fuel inlet and a fuel outlet aligned along an axis. A core pipe that includes a first opening and an opposite second opening that defines an inner zone, the core pipe extends axially within the annular pipe and is surrounded by the annular pipe. A space between the annular pipe and the core pipe defines a first annular zone. A burner elbow defines a cavity and includes an outlet that is attached to the inlet of the annular pipe, the burner elbow is configured to supply a fuel airflow mixture including pulverized fuel and primary air to the fuel inlet of the annular pipe and the first opening of the core pipe.

The first opening of the core pipe is eccentrically aligned relative to the fuel inlet of the annular pipe such that the first opening is configured to capture and separate a portion of primary air from the fuel airflow mixture. The fuel airflow mixture passing through the burner elbow is divided into an outer fuel rich stream having an increased amount of pulverized fuel within the first annular zone and an inner fuel-lean stream having an increased amount of primary air within the inner zone.

In another embodiment, the cavity of the burner elbow includes an inner surface that defines a generally bulbous shape such that as fuel airflow mixture passes through the cavity, the burner elbow is configured to separate a portion of pulverized coal from the fuel airflow mixture to enter the first annular zone of the burner.

In one embodiment, the center air jet burner further includes an orifice deflector that protrudes from at least one of an inner surface of the burner elbow and an inner surface of the annular pipe, the orifice deflector is configured to redistribute the flow of the fuel airflow mixture within the first annular zone such that the fuel rich stream is evenly distributed within the first annular zone.

These and other non-limiting characteristics are more particularly described below.

BRIEF DESCRIPTION OF THE DRAWINGS

The following is a brief description of the drawings, which are presented for the purposes of illustrating the exemplary embodiments disclosed herein and not for the purposes of limiting the same.

FIG. 1A is a cross sectional view of a first embodiment of the center air jet burner assembly of the present disclosure;

FIG. 1B is a partial cut out view of the center air jet burner assembly of FIG. 1A;

FIG. 1C is a partial cut out view of a deflector orifice of the center air jet burner assembly of FIG. 1B;

FIG. 2A is a cross sectional view of a second embodiment of the center air jet burner assembly of the present disclosure;

FIG. 2B is a partial cut out view of the center air jet burner assembly of FIG. 2A;

FIG. 3A is a cross sectional view of a third embodiment of the center air jet burner assembly of the present disclosure;

FIG. 3B is a partial cut out view of the center air jet burner assembly of FIG. 3A;

FIG. 4 is a cross sectional view of a fourth embodiment of the center air jet burner assembly of the present disclosure;

FIG. 5A is a cross sectional view of a fifth embodiment of the center air jet burner assembly of the present disclosure;

FIG. 5B is a partial cut out view of the center air jet burner assembly of FIG. 5A;

FIG. 6A is a cross sectional view of a sixth embodiment of the center air jet burner assembly of the present disclosure;

FIG. 6B is a partial cut out view of the center air jet burner assembly of FIG. 6A;

FIG. 7A is a cross sectional view of a seventh embodiment of the center air jet burner assembly of the present disclosure;

FIG. 7B is a partial cut out front perspective view of the center air jet burner assembly of FIG. 7A;

FIG. 7C is a partial cut out side perspective view of the deflector orifice of the center air jet burner assembly of FIG. 7B;

FIG. 8A is a cross sectional view of an eighth embodiment of the center air jet burner assembly of the present disclosure;

FIG. 8B is a partial cut out front perspective view of the center air jet burner assembly of FIG. 8A;

FIG. 8C is a partial cut out side perspective view of the deflector orifice of the center air jet burner assembly of FIG. 8B;

FIG. 9A is a cross sectional view of a ninth embodiment of the center air jet burner assembly of the present disclosure;

FIG. 9B is a partial cut out view of the center air jet burner assembly of FIG. 9A;

FIG. 10A is a cross sectional view of a tenth embodiment of the center air jet burner assembly of the present disclosure;

FIG. 10B is a partial cut out view of the center air jet burner assembly of FIG. 10A;

FIG. 11A is a cross sectional view of an eleventh embodiment of the center air jet burner assembly of the present disclosure;

FIG. 11B is a partial cut out view of the center air jet burner assembly of FIG. 11A;

FIG. 12A is a cross sectional view of a twelfth embodiment of the center air jet burner assembly of the present disclosure; and FIG. 12B is a partial cut out view of the center air jet burner assembly of FIG. 12A.

DETAILED DESCRIPTION

A more complete understanding of the components, processes, and apparatuses disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description, it is to be understood that like numeric designations refer to components of like function.

The singular forms "a," "an," and "the" include plural referents unless the context clearly dictates otherwise.

As used in the specification and in the claims, the term "comprising" may include the embodiments "consisting of" and "consisting essentially of."

Numerical values should be understood to include numerical values which are the same when reduced to the same number of significant figures and numerical values which differ from the stated value by less than the experimental error of conventional measurement technique of the type described in the present application to determine the value.

As used herein, approximating language may be applied to modify any quantitative representation that may vary without resulting in a change in the basic function to which it is related. Accordingly, a value modified by a term or terms, such as "about" and "substantially," may not be limited to the precise value specified, in some cases. The modifier "about" should also be considered as disclosing the range defined by the absolute values of the two endpoints. For example, the expression "from about 2 to about 4" also discloses the range "from 2 to 4."

It should be noted that many of the terms used herein are relative terms. For example, the terms "upper" and "lower" are relative to each other in location, i.e. an upper component is located at a higher elevation than a lower component in a given orientation. The terms "inlet" and "outlet" are relative to a fluid flowing through them with respect to a given structure, e.g. a fluid flows through the inlet into the structure and flows through the outlet out of the structure. The terms "upstream" and "downstream" are relative to the direction in which a fluid flows through various components, i.e. the flow fluids through an upstream component prior to flowing through the downstream component.

The terms "horizontal" and "vertical" are used to indicate direction relative to an absolute reference, i.e. ground level. However, these terms should not be construed to require structures to be absolutely parallel or absolutely perpendicular to each other. For example, a first vertical structure and a second vertical structure are not necessarily parallel to each other. The terms "top" and "bottom" or "base" are used to refer to surfaces where the top is always higher than the bottom/base relative to an absolute reference, i.e. the surface of the earth. The terms "above" and "below" are used to refer to the location of two structures relative to an absolute reference. For example, when the first component is located above a second component, this means the first component will always be higher than the second component relative to the surface of the earth. The terms "upwards" and "downwards" are also relative to an absolute reference; an upwards flow is always against the gravity of the earth.

To the extent that explanations of certain terminology or principles of the burner, boiler and/or steam generator arts may be necessary to understand the present disclosure, the reader is referred to *Steam/its generation and use,* 40th Edition, Stultz and Kitto, Eds., Copyright 1992, The Babcock & Wilcox Company, and to *Steam/its generation and use,* 41st Edition, Kitto and Stultz, Eds., Copyright 2005, The Babcock & Wilcox Company, the texts of which are hereby incorporated by reference as though fully set forth herein.

Referring initially to FIGS. 1A, 1B and 1C, cylindrical center air jet burner 10 includes outer annular pipe 11 and an interior tubular core pipe 12. The annular pipe 11 includes a fuel inlet 26 and a fuel outlet 28 aligned along an axis. The core pipe 12 that includes a first opening 19 and an opposite second opening 20 that defines an inner zone 24. The core pipe 12 extends axially within the annular pipe 11 and is surrounded by the annular pipe 11. A space between the annular pipe 11 and the core pipe 12 defines a first annular zone 32.

A burner elbow 18 defines a cavity and includes an inlet 35 and an annular outlet 36 that is attached to the inlet 26 of the annular pipe 11. The burner elbow 18 is configured to supply a fuel airflow mixture (FA) including pulverized coal and primary air to the fuel inlet 26 of the annular pipe 11 and the first opening 19 of the core pipe 12.

The section of pipe adjacent to the inlet 35 of the burner elbow 18 includes an eccentric reducer ER wherein a diameter of a vertical portion 37 is smaller than a diameter of the elbow portion 39. In one embodiment the vertical portion 37 can have a diameter that measures about 22.5" wherein the elbow portion 39 can have a diameter that measures about 29". The elbow portion includes a larger region 41 adjacent the elbow outlet 36 that increases space above the first opening 19 of the core pipe 12. The larger region 41 can be a generally bulbous shape. Additionally, the elbow can have a contracted section 43 axially downstream the larger region 41 that has a reduced diameter than the larger region 41. Particle concentration of pulverized coal and other particles is increased at the larger region 41. In essence, the eccentric reducer ER accelerates the fuel airflow mixture FA along the outside radius of the burner elbow 18 to improve centrifugal separation of the pulverized coal from the primary air.

Particle flux distributions positioned near a twelve o'clock or upper position is very high for low quality pulverized coal while it is very low at the six o'clock or lower position, due to the arrangement of the burner elbow. The first opening 19 of the core pipe 11 is eccentrically aligned relative to the fuel inlet 26 of the annular pipe 11 such that the first opening 19 is configured to capture and separate a portion of primary air PA from the fuel airflow mixture FA. The fuel airflow mixture FA passing through the burner elbow 18 is divided into an outer fuel rich stream PC having an increased amount of pulverized coal within the first annular zone 32 and an inner fuel-lean stream PA having an increased amount of primary air within the inner zone 24. In one embodiment, the eccentrically aligned core pipe 12 defines a 2"-3" gap along the bottom portion of the core pipe 12 and the annular pipe 11 and about an 6" to 12" gap at the top portion of the core pipe 12 and the annular pipe 11 at the first opening 19. These gaps defined by the eccentric alignment of the core pipe 12 relative to the annular pipe 11 can be identified by a ratio such that lower gap is between about ⅙ to ½ the size of the upper gap adjacent the first opening 19. More particularly, the lower gap is about ¼ the size of the upper gap.

The first opening 19 is adjacent an upstream end region 22 and the second opening 20 is adjacent the downstream end region 16. A reducing section 26 is located between end regions 16 and 22. This section reduces the cross-sectional area of core pipe 12 in an upstream to downstream direction. Such a reduction can be defined as a ratio wherein the first opening 19 is about 1.5 times the cross sectional area of the second opening 20. As shown, downstream end region 16 of the core pipe 12 terminates at the fuel outlet 28 of burner assembly 10.

An orifice deflector 30 is secured within the burner assembly 10 and is configured to redistribute the flow of the fuel airflow mixture FA within the first annular zone 32 such that the fuel rich stream PC is distributed within the first annular zone 32. The orifice deflector 30 can be configured to be inserted within a slot 34 located along the outer surface of the annular pipe 11 or can be conformed to be attached to an inner surface of the annular pipe 11 or optionally to an inner surface of the burner elbow 18. The orifice deflector 30 projects inwardly toward the core pipe 12 and is axially spaced from the first opening 19. Particularly, the position of the orifice deflector 30 relative to the first opening 19 of the core pipe 12 can vary from about 8" to about 12" such that the upstream end region 22 is at least partially located within the cavity of the elbow 18.

The orifice deflector 30 can include a generally disc shape body 40 with a cutout 44 therein that forms an arched orientation that extends less that 360 degrees around the cross sectional area of the burner elbow 18 and/or annular pipe 11. Preferably, the deflector 30 extends about 120 degrees to about 340 degrees, more preferably from about 180 to about 270 degrees. Additionally, in one embodiment, the orifice deflector 30 extends toward the core pipe 12 and defines a gap with the outer surface of the core pipe 12. The gap can be variable and in one embodiment is about 5" wide.

The orifice deflector 30 is configured to initially distribute and disperse the fuel/pulverized coal collected along an outer bend 42 of elbow 18 toward and around a perimeter of the core pipe 12. The orifice deflector 30 can include at least one protrusion 45 directed towards the airflow (such as an equilateral triangle) to divert particle buildup that accumulates around region 41. It also adds flow resistance to the fuel rich stream PC path thereby enhancing the air flow through the core pipe 12. The orifice deflector 30 disperses solid particulate within burner 10 that travel within the first annular zone 32. Generally, the orifice deflector 30 can form an arc of various dimensions within the cross sectional area of the burner 10 that projects radially inward toward the core pipe 12 to disperse the fuel before it releases through the fuel outlet 28.

A burner register 46 surrounds annular pipe 11. SA enters burner register 46 at entrance 47 and proceeds within inner annular zone 48 and outer annular zone 49 between pipe 11 and register 46. Distribution/discharge vanes 14 are in the secondary air zone portion of the burner to impart swirl to SA as it surrounds the fuel jet leaving burner into a combustion area 25. The vanes 14 are placed within annular zones 48 and 49 to promote sufficient air/fuel mixing in outlet zone 28. Additionally, the burner 10 can optionally include air separation vane ASV (See U.S. Pat. No. 4,915,619 incorporated by reference herein) at the outlet of the inner zone 48 and a flame stabilizing ring FSR at fuel outlet 28.

During operation, an air-coal mixture FA flows into burner elbow 18 having a secondary centrifugal rotating flow established therein. Generally, the pulverized coal is concentrated toward the outside radius of elbow 18. As the coal flows around elbow 18, a small portion (approximately 10%) of the coal enters the first opening 19 of the core pipe 12 along with approximately half or a larger portion of primary air of the fuel air mixture. This inner, fuel lean stream PA proceeds through reduction section 26 where it is accelerated to an average velocity greater than that in annular zone 32 and elbow 18 due to the decrease in cross-sectional area. This fuel-lean stream continues along the core pipe 12 until being ejected out the second end 20 therein to combustion area 25.

Concurrently, the fuel-rich stream PC with a large portion (approximately 90%) of the pulverized coal flows along the inner surface of the burner elbow 18 and enters into the first annular zone 32 and interacts with the orifice deflector 30 that is axially spaced downstream from the first opening 19 of the core pipe 12. The coal rich stream PC is deflected downward and radially inwardly around the perimeter of core pipe 12. As the deflected coal-rich stream PC continues toward exit 28, its velocity is decreased in downstream end region 16 due to the increase in flow area after passing reducing section 26. The inner fuel-lean stream, due to its greater velocity, passes through this initial combustion area 25 before slowing down and taking part in the combustion process downstream of the burner. The air in this stream is consequently not available for combustion in the initial combustion region adjacent burner outlet 28.

$NO_x$ reduction is accomplished by reducing the stoichiometry in the fuel mixture FA itself by using a burner assembly 10, which slowly mixes the fuel stream with the combustion air. The result is a combustion region immediately downstream burner outlet 28 having a lower stoichiometry due to the high velocity of the fuel-lean stream PA exiting the second opening 20 which does not mix with the fuel in this combustion area 25. The amount of combustion air available in combustion area 25 is crucial to $NO_x$ formation since this is where coal devolatilization takes place and one of the greatest influences on $NO_x$ formation if not the greatest influence is the amount of oxygen available to the volatile nitrogenous species evolved from the coal particles in this combustion region. Reducing the amount of oxygen available in this region sharply reduces the amount of $NO_x$ formed. Further, the subsequent addition of oxygen after devolatilization has occurred has a relatively minor impact on subsequent $NO_x$ formation thereby enabling later and complete combustion of the coal downstream of combustion area 25.

Turning now to FIGS. 2-12 wherein the same reference numbers relate to similar elements. Alternative embodiments of the invention are disclosed that illustrate differences to the relative sizes and orientations of the orifice deflector 30, the first opening 19 and the burner elbow 18. The fuel flow splits can be altered and/or changes in the cross-sectional area can be made to optimize performance with a particular application. Some such changes might be, for example, to size components for a higher coal-lean jet velocity to accomplish even lower $NO_x$ formation or other dimensions may vary to accomplish a lower coal-rich stream velocity for a particular difficult-to-ignite coal or solid fuel.

FIGS. 2A, 2B, 3A and 3B illustrate another embodiment of the orifice deflector 50 that includes a plurality of angled blocks 52 positioned along a top portion of the outer surface of the eccentric core pipe 12 and extends to the inner surface of the annular pipe 11. FIGS. 2A and 2B illustrate an embodiment with seven blocks 52 having a 45 degree open orientation that is configured to disperse the flow of fuel rich air in a counter clockwise direction. FIGS. 3A and 3B include three additional blocks 54 upstream of blocks 52. The additional blocks can be axially spaced about 3" from the first opening 19 of the core pipe 12.

FIGS. 4, 5A and 5B illustrates an embodiment of the burner assembly 10 such that the orifice deflector 60 includes a body having a generally arched orientation located about 6" from the first opening of the core pipe. The body is inserted into the slot 34 and extends about 1.5" from the inner surface of the annular pipe 11. The orifice deflector 60 of this embodiment can have a thick body 64 or a thin body 62 that extends about 120 degrees and up to 300 degrees about the cross sectional area of the annular pipe 11.

As illustrated by FIGS. 6A and 6B, it is clear that the first opening 19 of the core pipe 12 is aligned along a core pipe axis 76 that is radially spaced from a central axis 70 of the burner assembly 10. In this embodiment, the first opening 19 is eccentric to the annular pipe 11 by about 3" while the second opening of the core pipe 12 is concentric to the annular pipe 11 at the outlet 28. Here, the orifice deflector includes five wedges 72 and twelve blocks 74.

FIGS. 7A, 7B and 7C illustrate another embodiment of the orifice deflector 80 that is spaced about 10" from the first opening 19 of the core pipe 12 and radially protrudes inwardly about 3.5". This embodiment of the orifice deflector 80 extends about 210 degrees about the cross sectional area of the annular pipe 11.

FIGS. 8A, 8B and 8C illustrate another embodiment of the orifice deflector 90 that is spaced about 10.5" from the first opening 19 of the core pipe 12 and radially protrudes inwardly about 3". This embodiment of the orifice deflector 90 extends about 210 degrees about the cross sectional area of the annular pipe 11.

FIGS. 9A and 9B illustrate another embodiment of the orifice deflector 100 that is spaced about 8" from the first opening 19 of the core pipe 12 and radially protrudes inwardly about 1.5". This embodiment of the orifice deflector 100 extends about 180 degrees about the cross sectional area of the annular pipe 11.

FIGS. 10A and 10B illustrate another embodiment of the orifice deflector 110 that is spaced about 12" from the first opening 19 of the core pipe 12 and radially protrudes inwardly about 2.5". This embodiment of the orifice deflector 110 extends about 270 degrees about the cross sectional area of the annular pipe 11.

FIGS. 11A and 11B illustrate another embodiment of the orifice deflector 120 that is spaced about 12" from the first opening 19 of the core pipe 12 and radially protrudes inwardly about 3". This embodiment of the orifice deflector 110 extends about 270 degrees about the cross sectional area of the annular pipe 11.

FIGS. 12A and 12B illustrate another embodiment of the orifice deflector 130 that is spaced about 12" from the first opening 19 of the core pipe 12 and radially protrudes inwardly about 2.8". This embodiment of the orifice deflector 110 extends about 270 degrees about the cross sectional area of the annular pipe 11.

The burner assembly 10 is equally well suited for other combustion applications of pneumatically transported solid fuels besides coal such as coke, wood chips, saw dust, char, peat, biomass, etc. Alternately, the device can also serve in non-combustion applications when the process would similarly benefit from stream concentrations with or without the acceleration/deceleration feature. Due to the construction of the disclosed burner assembly 10, it can be retrofitted into existing burners that could benefit by the features and advantages of this device.

The disclosed device can be referred to as a flame stabilized center air jet burner (FSAJ) and it improves upon the art to provide an effective burner for firing LQ coals. The FSAJ uses a device to extract a large portion of the PA and inject it downstream in the flame. The stoichiometry for the PA stream with LQ coal often amounts to 0.40 to 0.50 (40 to 50% of theoretical air requirements) because LQ coals require disproportionately large amounts of PA. The PA alone provides a center stoichiometry near optimum values as determined for center air jet burners. There is no stoichiometric need for supplemental SA to the center of the flame with LQ coal. There is generally sufficient PA to supply air to the flame to improve combustion and reduce excess air requirements if done properly. However, there is a need to reduce the influence of this large, relatively cold, PA stream in the burner throat. The FSAJ device is an improvement over previous burners to further accelerate the captured stream within the center element, and further decelerate the main fuel stream surrounding the center element. This serves to jet much of the relatively cold PA stream past the ignition zone, so as not to impair ignition by displacing the mass of cold PA stream from the flame zone allowing the flame zone to reach ignition temperature with less heat, and then this PA serves to feed combustion downstream to provide needed air to the center of the flame. It decelerates the main fuel jet which provides more ignition time for the LQ coal to ignite, as needed recognizing the high quantities of inert materials in such coal.

The FSAJ burner improves on the structure of previously known burners. The FSAJ device is designed to accomplish improved separation efficiency. The device is intended to separate only PA from the PA/PC stream entering the burner, but some PC also accompanies the separated PA. The FSAJ uses an eccentric entrance to more efficiently remove PA while reducing PC in the separated stream. Additionally, the FSAJ provides improved coal dispersement in the coal nozzle, while situating the associated devices in a portion of the burner external to a windbox which supplies a common source of hotter secondary air. The extremely erosive characteristic of many LQ coals requires the use of ceramic materials and the like to reduce the rate of erosion of burner components. Burner components in the coal nozzle upon which coal particles impinge (high angle of attack) are particularly vulnerable to erosion, even with ceramic materials. The FSAJ provides improved fuel distribution while providing ready access to components which will eventually need maintenance due to erosion.

The combined attributes of the FSAJ exhibit much improved flame stability based on CFD analysis. This indicates the FSAJ can afford to divert some SA to an Over Fire Air system (OFA) while still providing stable flames. The use of OFA in combination with FSAJ will further reduce $NO_x$ emissions using combustion staging which will allow for stable flame operation of the burners with reduced secondary air flow.

The FSAJ accomplishes improved flame stability, like that of a PAX burner, without resorting to the additional hardware associated with a PAX burner, providing a lower cost solution for firing LQ coals.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

The exemplary embodiments have been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A center air jet burner for burning coal or low quality fuel comprising:

an annular pipe that includes a fuel inlet and a fuel outlet aligned along an axis;

a core pipe that includes a first opening and an opposite second opening that defines an inner zone, wherein the core pipe extends axially within the annular pipe and is surrounded by the annular pipe, and a space between the annular pipe and the core pipe defines a first annular zone; and a burner elbow that defines a cavity and includes an outlet that is operably secured to the inlet of the annular pipe, the burner elbow being configured to supply a fuel airflow mixture including (i) coal or pulverized low quality fuel and (ii) primary air to the fuel inlet of the annular pipe and the first opening of the core pipe;

wherein the first opening of the core pipe is eccentrically aligned relative to the fuel inlet of the annular pipe such that the first opening is configured to capture and separate a portion of primary air from the fuel airflow mixture such that the fuel airflow mixture passing through the burner elbow is divided into an outer fuel rich stream having an increased amount of coal or pulverized fuel within the first annular zone and an inner fuel-lean stream having an increased amount of primary air within the inner zone, and an orifice deflector that is secured within the burner and protrudes from at least one of an inner surface of the burner elbow and an inner surface of the annular pipe, the orifice deflector being configured to redistribute the flow of the fuel airflow mixture within the first annular zone such that the fuel rich stream is distributed within the first annular zone;

wherein the inner surface of the burner elbow and the inner surface of the annular pipe have a generally circular cross sectional orientation such that the orifice deflector includes a generally disc shaped body with a cutout therein that is configured to abut less than 360 degrees of a cross sectional surface of at least one of the inner surface of the burner elbow and the inner surface of the annular pipe;

wherein the first opening of the core pipe is axially spaced from the orifice deflector within the burner and the axial space between the orifice deflector and the first opening of the core pipe is between about ⅓ and ½ the diameter of the core pipe.

2. The center air jet burner of claim 1, wherein a portion of the core pipe adjacent the first opening is axially spaced from the inlet of the annular pipe and is located within the cavity of the burner elbow.

3. The center air jet burner of claim 1, wherein the cavity of the burner elbow includes an inner surface such that as fuel airflow mixture passes through the cavity, the burner elbow is configured to separate a portion of pulverized fuel from the fuel airflow mixture to enter the first annular zone of the burner.

4. The center air jet burner of claim 1, wherein the orifice deflector is configured to abut between about 120 degrees to 345 degrees of at least one of the inner surface of the burner elbow and the inner surface of the annular pipe.

5. The center air jet burner of claim 1, wherein the orifice deflector is configured to abut between about 180 degrees to about 270 degrees of at least one of the inner surface of the burner elbow and the inner surface of the annular pipe.

6. The center air jet burner of claim 1, wherein the orifice deflector includes at least one protrusion that extends from a surface of the orifice deflector that is configured to redistribute airflow within the first annular zone.

7. The center air jet burner of claim 4, wherein the at least one protrusion is an equilateral triangle shaped protrusion.

8. The center air jet burner of claim 1, wherein the second opening of the core pipe is concentric to the outlet of the annular pipe.

9. The center air jet burner of claim 1, wherein the second opening of the core pipe has a smaller cross sectional area than the first opening of the core pipe.

10. The center air jet burner of claim 7, wherein the cross sectional area of the first opening is about 1.5 times the cross sectional area of the second opening of the core pipe.

11. The center air jet burner of claim 1, wherein the first opening of the core pipe is elliptical in shape.

12. The center air jet burner of claim 1, wherein the core pipe and annular pipe define an upper gap and a lower gap along the fuel inlet, such that the size of the lower gap is between about ⅙ to ½ the size of the upper gap.

13. The center air jet burner of claim 10, wherein the size of the lower gap is about ¼ the size of the upper gap.

14. The center air jet burner of claim 1, wherein the orifice deflector is configured to abut between about 180 degrees to 345 degrees of the cross sectional surface of at least one of the inner surface of the burner elbow and the inner surface of the annular pipe.

15. The center air jet burner of claim 1, wherein the orifice deflector is axially spaced between about 8" to about 12" from the first opening of the core pipe.

* * * * *